US007694610B2

(12) United States Patent
Flores et al.

(10) Patent No.: US 7,694,610 B2
(45) Date of Patent: Apr. 13, 2010

(54) PHOTO-MULTIPLIER TUBE REMOVAL TOOL

(75) Inventors: Thomas H. Flores, Streamwood, IL (US); William J. Hanrahan, Hoffman Estates, IL (US)

(73) Assignee: Siemens Medical Solutions USA, Inc., Malvern, PA (US)

( * ) Notice: Subject to any disclaimer, the term of this patent is extended or adjusted under 35 U.S.C. 154(b) by 0 days.

(21) Appl. No.: 11/769,359

(22) Filed: Jun. 27, 2007

(65) Prior Publication Data

US 2009/0000428 A1 Jan. 1, 2009

(51) Int. Cl.
*B25B 13/48* (2006.01)
*B25B 13/02* (2006.01)

(52) U.S. Cl. ..... 81/176.2; 81/119

(58) Field of Classification Search ..... 81/60, 81/176.1, 176, 15, 176.2, 119, 121.1, 124.6, 81/177.5

See application file for complete search history.

(56) References Cited

U.S. PATENT DOCUMENTS

| | | | | | |
|---|---|---|---|---|---|
| 1,167,242 | A * | 1/1916 | Wright | ..... | 81/176.15 |
| 1,512,559 | A * | 10/1924 | Moore | ..... | 81/119 |
| 2,982,160 | A * | 5/1961 | Little | ..... | 81/60 |
| 5,524,511 | A * | 6/1996 | Taka's | ..... | 81/176.15 |
| 5,699,701 | A * | 12/1997 | Cotten, Jr. | ..... | 81/119 |
| 6,044,732 | A * | 4/2000 | Astle | ..... | 81/176.15 |
| 6,112,625 | A * | 9/2000 | Turtle | ..... | 81/177.2 |
| D513,465 | S * | 1/2006 | Carey | ..... | D8/14 |
| 7,096,758 | B1 * | 8/2006 | Ferkany et al. | ..... | 81/119 |

* cited by examiner

*Primary Examiner*—Hadi Shakeri
(74) *Attorney, Agent, or Firm*—Peter Kendall

(57) ABSTRACT

A tool is provided including a ratchet assembly including a handle grip and a socket; and a clamping assembly including a clamp with a notch; wherein the ratchet assembly is configured to be affixed to the clamping assembly so that a rotatable force applied to the handle grip actuates the clamp.

7 Claims, 5 Drawing Sheets

PHOTO-MULTIPLIER TUBE REMOVAL TOOL

BACKGROUND

1. Technical Field

The present disclosure generally relates to photo-multiplier tubes (PMTs). In particular, the present disclosure relates to a tool and process for the removal of PMTs during the refurbishment and/or repair of photo-detectors or photo-sensors.

2. Background of Related Art

Nuclear medicine is a unique medical specialty wherein radiation is used to acquire images which show the function and anatomy of organs, bones or tissues of the body. Radiopharmaceuticals are introduced into the body, either by injection or ingestion, and are attracted to specific organs, bones or tissues of interest. Such radiopharmaceuticals produce gamma photon emissions which emanate from the body and are detected by a radiation detector, such as a positron emission tomography (PET) camera.

Conventional PET cameras utilize a scintillation crystal, which absorbs the gamma photon emissions and emits light photons (or light events) in response to the gamma absorption. An array of photo-detectors, such as photo-multiplier tubes (PMTs), is positioned adjacent to the scintillation crystal. The PMTs receive the light photons from the scintillation crystal and produce electrical signals having amplitudes corresponding to the amount of light photons received. The electrical signals from the photo-multiplier tubes are applied to position computing circuitry, wherein the location of the light event is determined, and the event location is then stored in a memory, from which an image of the radiation field can be displayed or printed.

The PMTs are frequently removed during refurbishment and/or repair of the detectors via a PMT removal tool. One such removal tool resembles a gardener's trowel or a painting knife. A gardener's trowel is described in the prior art as shown and described by U.S. Pat. No. 5,327,612. A trowel 11 is constructed from a flat metal blade 13, a metal shank 15, and a handle 17. Shank 15 is integrally formed with, or is otherwise secured to, the top surface of blade 13. Shank 15 extends upwardly from the top surface of the blade providing a metal handle tang 19 which serves as the support structure of handle 17. Tang 19 extends distally from shank 15 and is raised above the plane of blade 13 in a generally parallel disposition thereto. Blade 13, shank 15 and tang 19 are typically forged of metal as one piece. The distal end of the flat metal blade 13 is preferably a sharp edge for allowing the user of the trowel 11 to separate and loosen the gel between a PMT and a metal shield.

However, this method of using a gardener's trowel or a painting knife can cause severe damage to the PMTs during the removal process. The sharp edge of the trowel is preferably inserted into a notch on a plastic end cap located on a top portion of the PMT assembly. Once the edge of the trowel is inserted into the notch, the user of the trowel applies variable forces to the PMT in order to loosen the PMT from the gel adhesive bond securing the PMT to the tube shield. The variable forces applied to detach the PMT can easily damage PMTs during the refurbishment and/or repair of the detectors.

Therefore, a need exists to provide for a more precise tool and process for the damage-free removal of PMTs during the refurbishment and/or repair of detectors.

SUMMARY

It is an aspect of the present disclosure to provide for a tool and process for the damage-free removal of PMTs during the refurbishment and/or repair of detectors. A further aspect of the present disclosure is to provide channel lock pliers that preferably grab the base of the PMT with the pliers and by applying a rotating motion, the PMT can effectively be released in a damage-free manner.

In accordance with the above-noted aspects of the present disclosure, a PMT removal tool is presented. The PMT removal tool enables an easy grip handle for safe and efficient removal of PMTs. In an exemplary embodiment of the present disclosure, the PMT tool includes a clamping mechanism that fits precisely at the base of the PMT without damaging the PMT. The PMT removal tool further reduces the time it takes to remove a PMT compared to previous tool removal methods. Furthermore, the PMT removal tool allows for increased safety during the removal of a PMT, increased re-usability of the PMTs, and a significant cost reduction for the replacement of any PMTs.

BRIEF DESCRIPTION OF THE DRAWINGS

The disclosure will become more clearly understood from the following detailed description in connection with the accompanying drawings, in which.

DETAILED DESCRIPTION

The following description is presented to enable one of ordinary skill in the art to make and use the disclosure and is provided in the context of a patent application and its requirements. Various modifications to the disclosed embodiments will be readily apparent to those skilled in the art and the generic principles herein may be applied to other embodiments. Thus, the present disclosure is not intended to be limited to the embodiments shown but is to be accorded the broadest scope consistent with the principles and features described herein.

Figure 1:
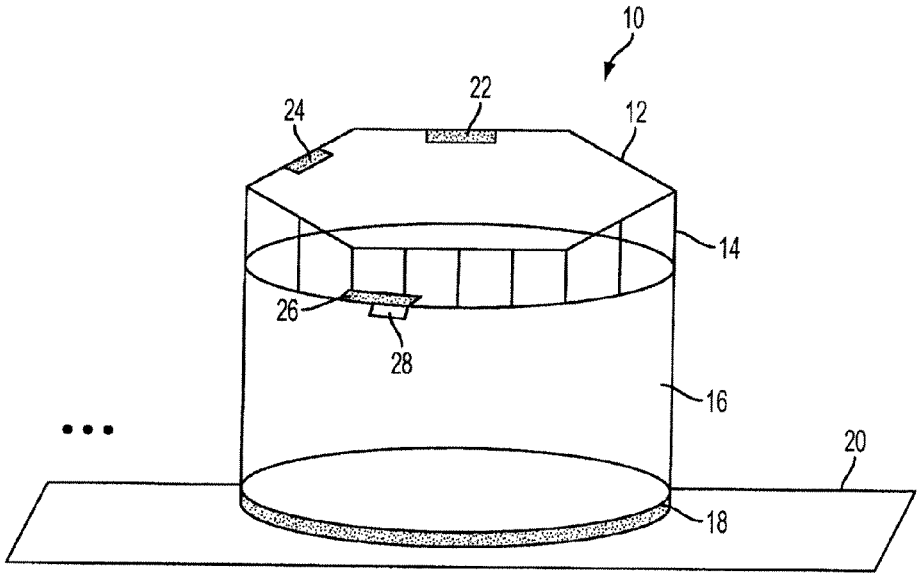
FIG. 1 PRIOR ART
FIG. 1 is a schematic illustration of a detector photo-multiplier tube (PMT)

Referring to FIG. 1, a schematic illustration of a detector photo-multiplier tube (PMT) assembly is presented. The PMT assembly 10 includes a circuit board 12, PMT cable connectors 14, a metal shield 16, a gel adhesive 18, a light pipe 20, a capacitor attachment point 22, a bias voltage attachment point 24, an end cap 26, and an end cap notch 28.

The circuit board 12 includes at least a capacitor attachment point 22 and a bias voltage attachment point 24. The circuit board is preferably shaped as a hexagonal circuit board. The cable connectors 14 connect the circuit board 12 to the top portion of the PMT assembly 10 located within the metal shield 16. The metal shield 16 is preferably shaped as a circular shield. The bottom portion of the PMT assembly (not shown) located within the metal shield 16 is secured to the inner bottom portion of the metal shield 16 via a gel adhesive 18. The gel adhesive 18 is preferably Silicone Die Electric Gel available from Dow Corning Corp. The outer bottom portion of the metal shield 16 is positioned on a light pipe 20. It is appreciated by one of ordinary skill in the art that a plurality of PMTs may be positioned on the light pipe 20. Preferably, 59 PMTs are positioned on top of the light pipe 20. Moreover, at the top portion of the PMT assembly 10 is located an end cap 26 having an end cap notch 28. The end cap 26 is preferably made of a plastic material. The end cap notch 28 is configured to receive a clamping mechanism for securing an external device configured to remove the PMT assembly 10.

The PMT assembly 10 is designed to be easily attached and detached from the metal shield 16, via the gel adhesive 18, in order to remove a defective PMT or to replace an existing PMT with an upgraded PMT. However, the gel adhesive 18 renders the removal of the PMT assembly 10 difficult when using tools designed for different applications not related to PMTs.

Figure 2:
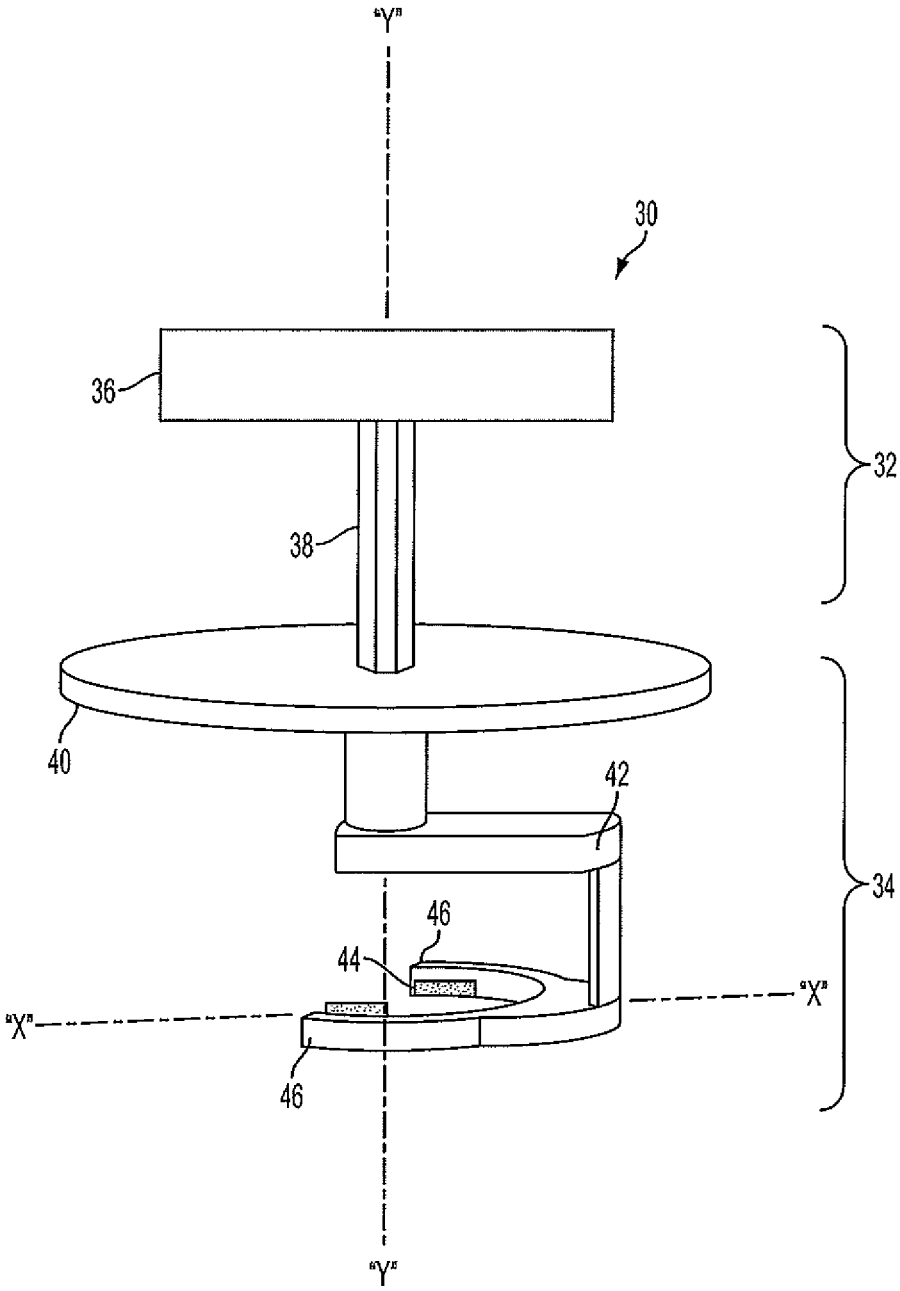
FIG. 2 is a schematic illustration of a PMT removal tool, in accordance with the present disclosure.

Referring to FIG. 2, a schematic illustration of a PMT removal tool, in accordance with the present disclosure is presented. The PMT removal tool 30 includes a an actuating assembly 32 and a clamp assembly 34.

The actuating assembly 32 includes a grip handle 36 and a shaft 38. The grip handle 36 is preferably a flexible grip handle. Additionally, a flexible band can be wound around the grip handle 36 to form a hand grip on the handle. A thicker (larger diameter) handle, as shown in FIG. 2, is advantageous in that the person's hand does not have to be as tightly curled, whereby the tendons in the hand do not stretch to any great extent. The person has a less cramped and more comfortable grip on the handle (handgrip) surface. The resilience of the hand grip is advantageous in that the person's fingers are enabled to depress the hand grip surface so as to minimize the possibility of slippage between the hand grip and the person's fingers. The shaft 38 is preferably a polygonal hex shaft.

The clamp assembly 34 includes a circular base 40, an arm 42, a pedestal 47, a pair of jaw members 46, and a clamp notch 44. Numerous types of clamp assemblies have been proposed for clamping one object to another, such as c-clamps, substantially u-shaped brackets which function as clamps, straps, pocket-type structures and the like. The pair of jaw members 46 extend in an "X" direction that is transverse to a longitudinal "Y" axis.

The actuating assembly 32 is detachable connected to the clamp assembly 34. A user of the PMT removal tool 30 may apply a counterclockwise or clockwise rotatable force on the grip handle 36 in order to compel the shaft 38 to rotate the clamp assembly 34, including the circular base 40, which in turn rotates the arm 42, the pedestal 47 and actuates the jaw members 46. The clamp assembly 34 is preferably designed to grab the PMT base at end cap 26, and in particular, at end cap notch 28 with the jaw members 46. Preferably, the end cap notch 28 of the PMT base is securedly connected to the clamp notch 44 of the clamp assembly 34.

A user of the PMT removal tool 30 may apply only a moderate rotatable force on the grip handle 36 to induce a clockwise or counter-clockwise motion. As the PMT assembly 10 (shown in FIG. 1) begins to loosen from the gel adhesive 18, the user may apply less of a rotatable force on the grip handle 36. Pressure may be applied to the PMT assembly 10 in a forward direction to commence the loosening from the gel adhesive 18. A user may then apply reverse pressure to the PMT assembly 10 to further aid in the loosening of the gel adhesive 18. In addition, pressure may be applied in a leftward or rightward direction as necessary until the gel adhesive 18 starts to break.

After the PMT assembly 10 is completely loosened, the PMT assembly 10 may be lifted out of the metal shield 16. A user may then use a razor blade scraper (not shown) to remove all visible signs of the gel residue left behind from the bottom portion of the PMT assembly 10, before inserting a new PMT into the metal shield 16. The inner bottom portion of the metal shield 16 is cleaned thoroughly without the use of any solvents or alcohol preparation pads, because such solutions may prevent the new PMT from bonding properly with the application of a fresh coat of gel adhesive 18.

Figure 3:
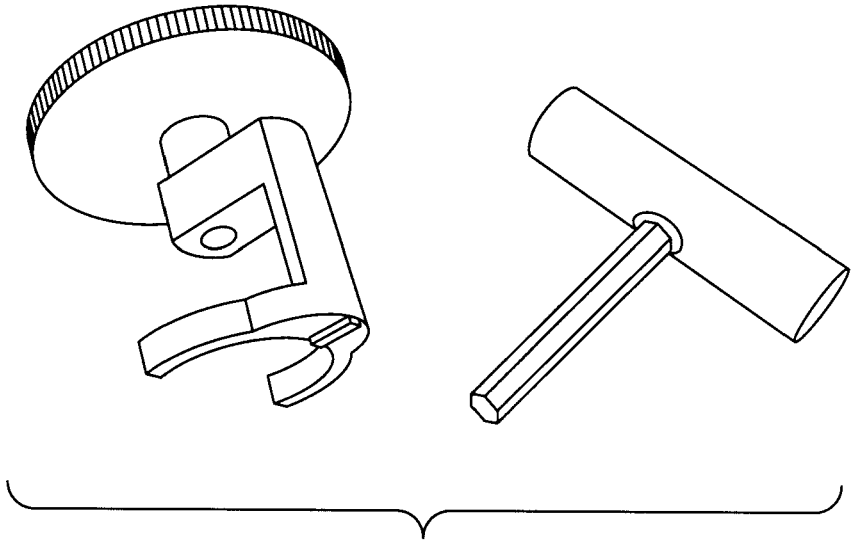
FIG. 3 is a schematic illustration of the PMT removal tool of FIG. 2, where the actuating assembly is detached from the clamp assembly, in accordance with the present disclosure.

Referring to FIG. 3, a schematic illustration of the PMT removal tool of FIG. 2, where the actuating assembly is detached from the clamp assembly 34, in accordance with the present disclosure is presented. The actuating assembly 32 may be detached from the clamp assembly 34 as shown in FIG. 3. This allows the user of the PMT removal tool 30 to easily replace the actuating assembly or the clamp assembly with other modifications of such components. This allows for easy interchangeability of grip handles or of shafts depending on the desired application. In addition, it allows for easy interchangeability of clamp/jaw sizes depending on the desired application.

Figure 4:
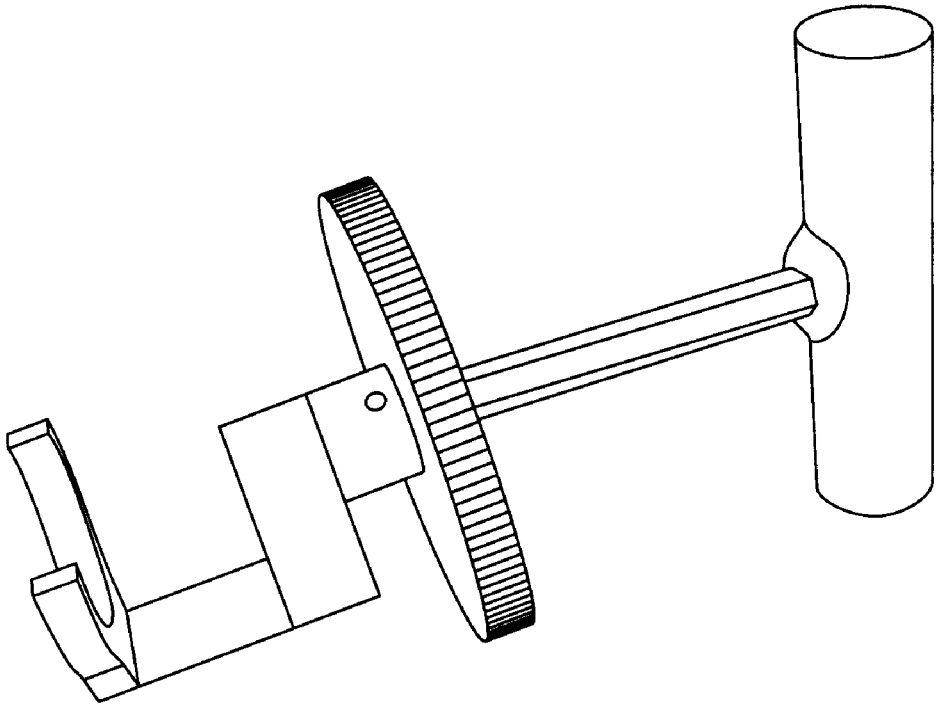
FIG. 4 is a schematic illustration of the PMT removal tool of FIG. 2, where the actuating assembly is attached to the clamp assembly, in accordance with the present disclosure.
Figure 5:
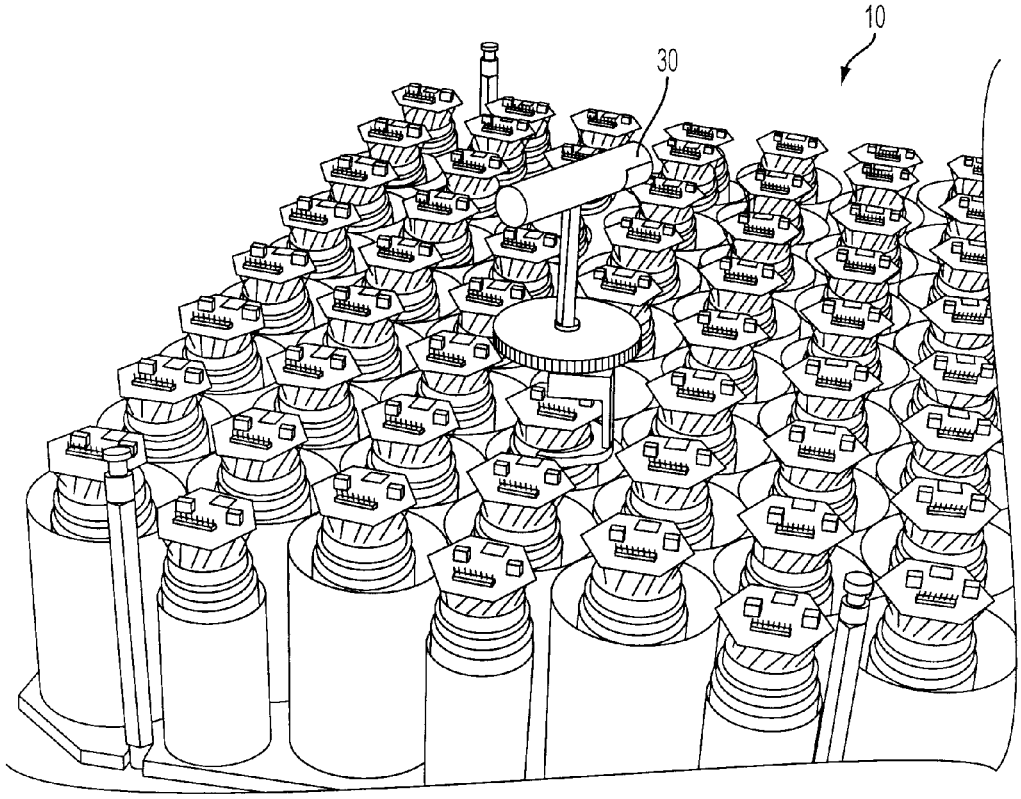
FIG. 5 is a schematic illustration of a plurality of PMTs within a plurality of metal shields, where the PMT removal tool of FIG. 2 is utilized to remove a PMT, in accordance with the present disclosure.

Referring to FIG. 4, a schematic illustration of the PMT removal of FIG. 2, where the actuating assembly 32 is attached to the clamp assembly 34, in accordance with the present disclosure is presented. The actuating assembly 32 may be attached from the clamp assembly 34 as shown in FIG. 4. In other words, the shaft 38 is connected to the top of the circular base 40 to form the assembled PMT removal tool 30:

Referring to FIG. 5, a schematic illustration of a plurality of PMTs within a plurality of metal shield, where the PMT removal tool of FIG. 2 is utilized to remove a PMT, in accordance with the present disclosure is presented. The PMT removal tool 30 is applied to one of the plurality of PMTs located on the light pipe 20 (shown in FIG. 1). Preferably there are 59 PMTs on a detector and each PMT may be removed individually when a detector is refurbished and/or repaired. The light pipe 20 is located between the detector and each of the plurality of PMTs.

Therefore, the PMT removal tool allows for an easy and damage-free removal of PMTs in order to be salvaged for re-use in detectors, and, in turn, save in the replacement cost of a damaged PMT. The PMT removal tool further provides for a safe and efficient method for removal of the PMT. The exemplary embodiments of the present disclosure further contribute to the quality and reliability of the finished detector product, and can be used in a factory or in the field.

Although the present disclosure has been described in accordance with the embodiments shown, one of ordinary skill in the art will readily recognize that there could be variations to the embodiment and these variations would be within the spirit and scope of the present disclosure. Accordingly, many modifications may be made by one of ordinary skill in the art without departing from the spirit and scope of the appended claims.

What is claimed is:

1. An installation tool for a photo-multiplier tube (PMT), wherein the PMT has a neck portion defining a circumferential surface and has an electronic circuit board oriented axially above the neck portion that projects radially outwardly past the circumferential surface, the tool comprising:

a clamp assembly having:

a rotational axis;

a circular base portion at a proximal end defining a central axis substantially coaxial with said rotational axis;

a jaw assembly including a pair of opposed jaws on one end thereof, the jaws defining an engagement surface conforming to the PMT neck portion circumferential surface and a centroidal axis substantially coaxial with said rotational axis;

a jaw gap defined within the engagement surface for receipt of the PMT neck therein;

a pedestal having an end coupled to the jaw assembly laterally offset from said rotational axis and generally projecting axially away from the jaws toward the proximal end of the clamp assembly, for providing clearance for receipt of the PMT electronic circuit board within the clamp assembly; and an arm coupled to the pedestal on the other end thereof distal the jaws and projecting generally toward said rotational axis; and an actuating assembly including a symmetrical handle, defining an axis of symmetry, coupled to the circular base portion of the clamp assembly at said proximal end, the axis of symmetry coaxial with said rotational axis.

2. The tool of claim 1, wherein the actuating assembly has a shaft coupled to the clamp assembly coaxial with the rotational axis.

3. The tool of claim 2, wherein shaft has a polygonal cross-sectional profile that engages a corresponding profile aperture defined by the clamp assembly.

4. The tool of claim 1, wherein clamp assembly and actuating assembly are selectively coupled to each other.

5. The tool of claim 1, wherein the handle has a T-shaped outer surface profile.

6. The tool of claim 1, wherein the opposed jaws engagement surface and the PMT neck portion respectively define mating notches that engage with each other.

7. A method for removing a photo-multiplier tube (PMT) that is adhesively bonded to a light pipe shield, wherein the PMT has a neck portion defining a circumferential surface that is bonded to the shield, and has an electronic circuit board oriented axially above the neck portion that projects radially outwardly past the circumferential surface, the method comprising:

providing an installation tool including a clamp assembly having: a rotational axis; a circular base portion at a proximal end defining a central axis substantially coaxial with said rotational axis: a jaw assembly including a pair of opposed jaws on one end thereof, the jaws defining an engagement surface conforming to the PMT neck portion circumferential surface and a centroidal axis substantially coaxial with the clamp rotational axis; a jaw gap defined within the engagement surface; a pedestal having an end coupled to the jaw assembly laterally offset from the said rotational axis and generally projecting axially away from the jaws toward the proximal end of the clamp assembly, and an arm coupled to the pedestal on the other end thereof distal the jaws and projecting generally toward the said rotational axis; and an actuating assembly including a symmetrical handle, defining an axis of symmetry, coupled to the circular base portion of the clamp assembly at said proximal end, the axis of symmetry coaxial with the said rotational axis;

engaging the PMT neck portion with an installation tool by sliding the opposing jaws transverse to the PMT neck and engaging said neck circumferential surface with the engagement surface; and thereafter simultaneously pushing and twisting the installation tool coaxially about the rotational axis without rocking same by grasping the handle, the twisting motion transverse to the rotational axis thereby breaking the adhesive bond between the PMT and light pipe shield while reducing likelihood of damage to the PMT that might be caused by rocking the PMT relative to the rotational axis.

* * * * *